United States Patent [19]

Schonbrun et al.

[11] 4,008,531

[45] Feb. 22, 1977

[54] PROTECTIVE FOOTWEAR

[75] Inventors: Tibor Schonbrun, Montreal; Victorien Tremblay, Laval, both of Canada

[73] Assignee: Genesport Industries Limited, Montreal, Canada

[22] Filed: Mar. 4, 1976

[21] Appl. No.: 663,749

[52] U.S. Cl. ..... 36/106; 36/2 R

[51] Int. Cl.[2] ..... A43B 00/00; A41D 17/00

[58] Field of Search ..... 36/106, 114, 115, 7.1, 36/83, 2 R, 71

[56] References Cited

UNITED STATES PATENTS

| | | | |
|---|---|---|---|
| 2,697,886 | 12/1954 | Spinali | 36/71 |
| 3,304,629 | 2/1967 | Meyers | 36/2 R |
| 3,693,270 | 9/1972 | Murray | 36/71 |
| 3,769,722 | 11/1973 | Rhee | 36/2 R |

*Primary Examiner*—Patrick D. Lawson
*Attorney, Agent, or Firm*—McFadden, Fincham & Co.

[57] ABSTRACT

A protective device adapted to protect the foot and shin area of a person, said device comprising a first member adapted to fit about the heel area, a second member adapted to cover the top portion of the foot, and a third member covering at least a portion of the shin area, said three members being secured together to form a composite structure, each of said members being formed of a protective material.

11 Claims, 7 Drawing Figures

PROTECTIVE FOOTWEAR

This invention relates to protective structures and more particularly, relates to a protective structure adapted to be worn about the shin and foot areas of a wearer.

In various sports such as, for example, karate, kick boxing, and the like, the feet are used extensively for purposes of attacking an opponent and also for defending oneself from blows delivered by an opponent. During training in the various arts and sports, and indeed, often during actual practice of these sports, it is desirable to protect the foot and shin areas of the participants from injury. Thus, a protective structure is needed for the foot of the attacker to protect the same against the many bruises which would otherwise occur. Similarly, the shin area often needs protection not only in the case of the person doing the attacking, but also for the defender for blocking of blows and the like.

Thus, it is highly desirable in such sports to employ protective paraphernalia for the foot and shin areas of the participants.

Heretofore, it has generally been proposed that such protective footwear be formed as a "shoe" type structure. In one embodiment, such prior art shoes would comprise a structure of a foam-like material which is molded or formed to the size of the person wearing the same. Frequently, such a structure is formed by molding two halves and then securing the halves together by adhesive or like means. However, such structures have been found to lack durability and tear easily.

Furthermore, to be readily adaptable for most uses, such an adhesively bonded molded shoe must have means for securing the same to the foot of the wearer. These means may comprise strap means or the like; however, the problems of securing the straps to the formed material are considerable and such a structure is not viable from the point of view of durability. Similarly, laces have not been found to be suitable as they loosen during use necessitating frequent retying in order to maintain a snug fit.

According to one aspect of the present invention, there is provided a protective device suitable for protecting the shin and foot areas of a wearer of the same. The protective device preferably comprises three members suitably secured together to form a structure wherein each member is adapted to protect a particular portion of the foot/lower leg of the person employing the device.

Each of the three above-mentioned members comprises a central core or inner portion of a protective material. The term "protective material" is employed in the sense of embodying any material suited for the purpose of protecting against and/or cushioning the effect of a blow delivered to or by the person employing the device. Suitable protective materials per se are well known in the art and may, for example, include such materials as rubber, both natural and synthetic, fibrous mats of woven or non-woven material, air-cushioned material, closed cell PVC material such as is marketed under the trademark ENSOLITE, etc.

According to one embodiment of the present invention, the protective material is encased by a further material enclosing the protective material and forming means by which each member may be attached or secured to other members. To this end, materials such as cotton, nylon, etc. may form the encasing structure about the protective material. If desired, the encasing material may itself add to the protective aspect of the particular member and furthermore, may be coated with a suitable low friction material to reduce irritation for the people employing the same. Thus, rubber or other well known materials may be employed.

In one embodiment of the invention, the encasing material presents outwardly directed flange-like portions which may be employed to secure the particular member to the other members. Thus, each member may have flanges extending thereabout which are secured to adjacent flanges by conventional fastening means such as sewing or the like. Alternatively, mating female-male fibrons may be utilized to secure the members together wherein the necessity of flanges is obviated.

In one preferred aspect of the present invention, there is provided a first member adapted to help protect the lower foot area. This lower foot portion protects the heel and side portions of the foot and will have a generally U-shaped configuration when seen from a top view and have a substantially greater height at the heel area as compared to the tow area of the foot. Not only does this member protect the heel area of the person employing the same, but moreover, mainly protects the opponent from injury through an accidental heel kick or side kick.

There is also provided a member adapted to protect the upper portion of the foot of the wearer and in one embodiment, this member may have a generally rectangular configuration adapted to fit within the arms of the upper portion of the U-shaped configuration of the lower foot protective member. This upper foot member may also extend to the ends of the arms of the U-shaped lower foot member to provide protection for the toe area. By securing the member in this position, there is provided an opening at the base of the U whereby the foot of the wearer may be inserted into the structure.

A third member forming a portion of the novel protective device of the present invention is adapted to protect the shin area of the user. The shin protector member is adapted to protect at least the shin portion of the lower leg of the wearer; to this end, this component may be preformed to the same general configuration. Alternatively, it may comprise a substantially rectangular piece of protective material which, due to the flexible nature of the protective material, will bend to the required configuration when worn.

Associated with the assembled structure of the present invention are retaining means for retaining the protective device in position on the wearer. In this respect, many types of straps and other retaining means known to those skilled in the art may be utilized. In a preferred embodiment, a pair of elastic strap means are employed. In this embodiment, the elastic straps are secured at the ends thereof to the flanges formed by the cover material of the protective members.

The first elastic strap means are associated with the shin protector member and may comprise one elastic strap extending about the rear portion of the leg for substantially the height of the member. Alternatively, a plurality of such elastic straps may be used at spaced apart locations. Still further, other suitable releasable fasteners such as those marketed under the trademark VELCRO, snap fasteners, etc. may be employed.

A further retainer means may be employed about the foot area of the user and to this end, an elastic strap extending from either the upper or lower foot member component underneath the foot of the wearer can be utilized.

Further objects and advantages of the present invention will become clear from the following description taken in conjunction with the accompanying drawings, in which.

Figure 1:
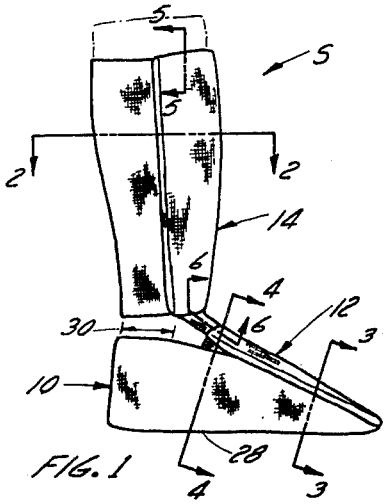
FIG. 1 is a perspective view of the protective boot according to the present invention.

Referring to the Figures in greater detail, reference character S designates the protective structure of the present invention.

Structure S, as shown in FIG. 1, comprises three portions — i.e., a lower foot member 10, an upper foot member 12, and a shin member 14. In general detail, lower side member 10 has a generally U-shaped configuration with a pair of parallel side walls 16 extending from the base of the U-shaped configuration in a tapering decreasing height manner. Thus, as may be seen from FIGS. 3 and 4, side walls 16 have an edge 28 forming the base in a straight line configuration. The upper margin of lower foot member 10 has a constant height with respect to base 28 for a portion designated by reference numeral 30; thereafter, as shown, the side walls 16 taper downwardly to meet base 28.

Figure 3:
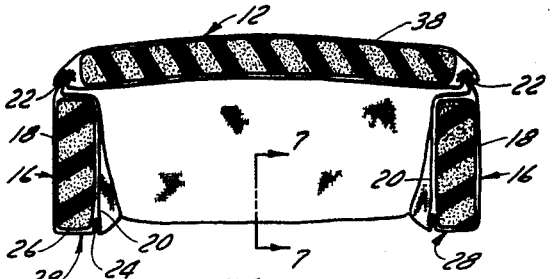
FIG. 3 is a sectional view of the foot member taken along the lines 3—3 of FIG. 1.
Figure 4:
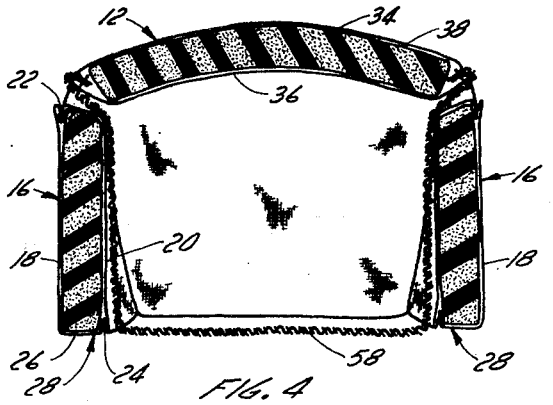
FIG. 4 is a further sectional view taken along the lines 4—4 of FIG. 1.

The exteriorly facing surface of side walls 16 comprises a covering or enclosure material shown in FIGS. 3 and 4 by reference numeral 18. Covering 18 extends about base 28 and along the exteriorly facing side. On the interior surface of walls 16 there is provided a further protective covering 20 which may be of a similar or dissimilar material with respect to covering 18. As shown, covering 20 extends about the interior wall of sides 16 and the top portion thereof. Coverings 20 and 18 are joined at 22 and 24 by suitable means such as stitching to provide a continuous exterior surface for lower foot member 10. It will be understood that coverings 20 and 18 may, if so desired, form a one-piece covering thus eliminating the stitching at 24.

Coverings 18 and 20 enclose a core 26 of protective material. Material 26 may be chosen from many well known suitable materials such as, for example, athletic foams, etc.

Upper foot member 12 also comprises a central core 38 of a protective material. Enclosing core 38 are exterior coverings 34 and 36 which are joined together along with coverings 20 and 18 at point 22 as best illustrated in FIGS. 3 and 4. Upper foot member 12 preferably extends from the toe portion of structure S upwardly along the side walls 16 for a substantial distance.

Figure 2:
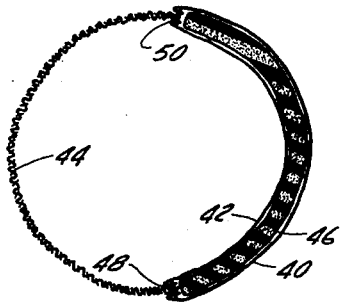
FIG. 2 is a sectional view of the shin member taken along the lines 2—2 of FIG. 1.
Figure 5:
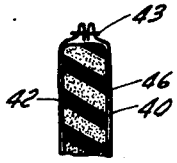
FIG. 5 is a detailed sectional view taken along the lines 5—5 of FIG. 1.

Shin member 14 is illustrated in FIGS. 1, 2 and 5 and reference will now be made thereto. The protective part of shin member 14 comprises an inner protective core 46 of a suitable protective material as discussed above surrounding which there is a pair of coverings 40 and 42 on both major faces thereof. Coverings 40 and 42 are joined on the side margins by suitable attachment means such as stitching 48 and 50. Also secured to coverings 40 and 42 is an elastic 44 which extends substantially the height of the shin member. It will be realized that the configuration shown in FIGS. 1 and 2 — i.e. substantially a circular configuration is that of the structure when a person is wearing the same. Normally, shin member 14 comprising the core and covering would tend to be substantially flat and planar with elastic 44 being co-planar therewith.

Figure 6:
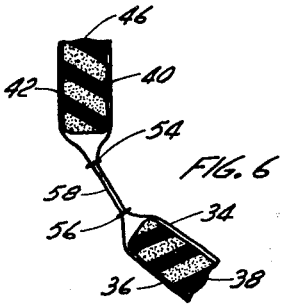
FIG. 6 is a sectional view taken along the lines 6—6 of FIG. 1.
Figure 7:
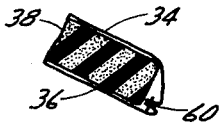
FIG. 7 is a sectional view taken along the lines 7—7 of FIG. 3.

At the uppermost margin of shin member 14, coverings 40 and 42 are secured by stitching 43 as illustrated in FIG. 5; at the lower extremity 52 of core 46, coverings 40 and 42 are again joined by means of stitching 54 as illustrated in FIG. 6. Also, as shown in FIG. 7, stitching 60 is employed along the toe area of upper foot member 12 attaching coverings 34 and 36.

In one embodiment, as illustrated in FIG. 6, coverings 34 and 40 of shin member 14 and upper foot member 12 respectively, form a continuous piece of material. Similarly, coverings 36 and 42 are of a one-piece construction. In this embodiment, as may be seen, coverings 34 and 36 are held together to enclose core 38 by stitching 56 at the upper side margin of core 38. Stitchings 54 and 56 are spaced apart so as to provide a portion 58 in which there is no protective material but rather comprises merely the coverings. This portion 58 permits flexing at the ankle portion of the protective structure S.

In the embodiment illustrated, means are provided for retaining the protective structure about the foot of the person comprising an elastic 58 which may fit around the instep of the wearer. Elastic 58 is adjoined to the structure and more particularly, the upper foot member 14 by means of stitching 22.

It will be understood that changes and modifications can be made to the above described embodiment without departing from the spirit and scope of the invention. Thus, for example, sides 16 may be manufactured substantially as described but without the flange portions. In such an embodiment, sides 16 would be secured to upper member 12 by male-female fibron attachment system such as is marketed under the trademark VELCRO. In such an embodiment, covering 36 may have secured thereto the female fibrons with the male fibrons being secured to the side walls 16. This would eliminate the necessity of flange portions. By employing the arrangement of the fibrons above-mentioned, irritation of the foot of the wearer by the male fibrons would be avoided.

Still further, the structure may include an elastic strap or like means such as is generally designated by reference numeral 72 between members 10 and 12 to relieve any stress on the stitching joining these two components together.

In a still further embodiment, a portion of the core 38 proximate the toe area may be "slit" for a portion of its depth and the coverings 34 and 36 stitched together so as to bend a portion of the upper foot member 12 downwardly to protect the toe area.

Still further, stitching may be employed in any of members 10, 12 or 14 to "bend" these members to have an arcuate configuration similar to that which it would have in use. All such changes and modifications are believed to be within the scope of the present invention.

What we claim is:

1. A protective device adapted to protect the foot and shin area of a person, said device comprising a first member adapted to fit about the heel area, a second member adapted to cover the top portion of the foot, and a third member covering at least a portion of the shin area, said three members being secured together to form a composite structure, each of said members being formed of a core of protective material and a covering thereabout, each of said coverings having at least one flange situated along an edge of said members, said members being secured together by means of said flanges.

2. The device of claim 1 wherein said flanges are secured together by stitching means.

3. The device of claim 1, additionally including retaining means for retaining said device in position on the foot of a wearer.

4. The device of claim 1, additionally including elastic strap means secured to one of said members for retaining said device in a desired position.

5. The device of claim 1 wherein said protective coverings comprise a rubberized nylon material.

6. The device of claim 1, additionally including elastic strap means on said third member, said elastic strap means extending from one side margin of said third member to a further side margin thereof.

7. The device of claim 6 wherein each of said members has attached thereto fibrons for mating engagement with other fibrons.

8. The device of claim 1 wherein each of said members has attached thereto fibrons for mating engagement with other fibrons.

9. A protective device adapted to protect the foot and shin area of a person, said device comprising a first generally U-shaped member having a rear wall extending arcuately between a pair of opposed side walls, said rear wall being adapted to encircle the heel of a wearer, said side walls extending from said rear wall and tapering therefrom to have a diminishing height, a second member adapted to cover the top portion of the foot, said second member extending between upper edges of said tapering side walls, and a third member adapted to cover at least a portion of the shin area, said three members being secured together to form a composite structure, each of said members being formed of a protective material.

10. The device of claim 9 wherein each of said members comprises a core of protective material and a covering thereabout.

11. The device of claim 10 wherein each of said coverings has at least one flange situated along an edge of the said members, said members being secured together by means of said flanges.

* * * * *